United States Patent [19]

Andrae et al.

[11] Patent Number: 4,793,081

[45] Date of Patent: Dec. 27, 1988

[54] ANIMATED SIGN

[76] Inventors: Ralph N. Andrae, 15 Morgan St., Crystal Lake, Ill. 60014; Richard R. Seiberlich, 442 N. Ella St. Apt. 2 South, Barrington, Ill. 60010

[21] Appl. No.: 50,871

[22] Filed: May 18, 1987

[51] Int. Cl.[4] ..... G09F 19/08

[52] U.S. Cl. ..... 40/414; 40/411; 40/614

[58] Field of Search ..... 40/411, 414, 415, 421, 40/423, 466, 614; 446/333, 338, 352, 353

[56] References Cited

U.S. PATENT DOCUMENTS

| | | | |
|---|---|---|---|
| 1,190,574 | 7/1916 | Oppenheimer | 40/421 |
| 1,804,297 | 5/1931 | Wintz | 40/421 X |
| 2,290,801 | 7/1942 | Dale et al. | 40/414 |
| 2,295,430 | 9/1942 | Seewald | 40/421 |
| 2,555,882 | 6/1951 | Guajardo | 40/421 X |
| 2,557,242 | 6/1951 | Simpson | 40/421 X |

*Primary Examiner*—Michael Koczo
*Assistant Examiner*—Peggy Neils
*Attorney, Agent, or Firm*—John J. Kowalik

[57] ABSTRACT

A motile sign in which a human face mask is motivated up and down to indicate "yes" in answer to a question on the sign "Are we open?" and in which the mask is oscillated horizontally to indicate "No", The mechanism for operating the mask comprises a pitman drive which is movable to a vertical position to move the face mask up and down and to a horizontal position to oscillate the mask horizontally and wherein the mechanism and mask are fitted into a box shaped frame which is formed to provide a cowling about the mask and cooperates therewith to conduct cooling air being fanned by the mask into the box for cooling a small electrical motor which operates the drive mechanism.

19 Claims, 2 Drawing Sheets

FIG. 1
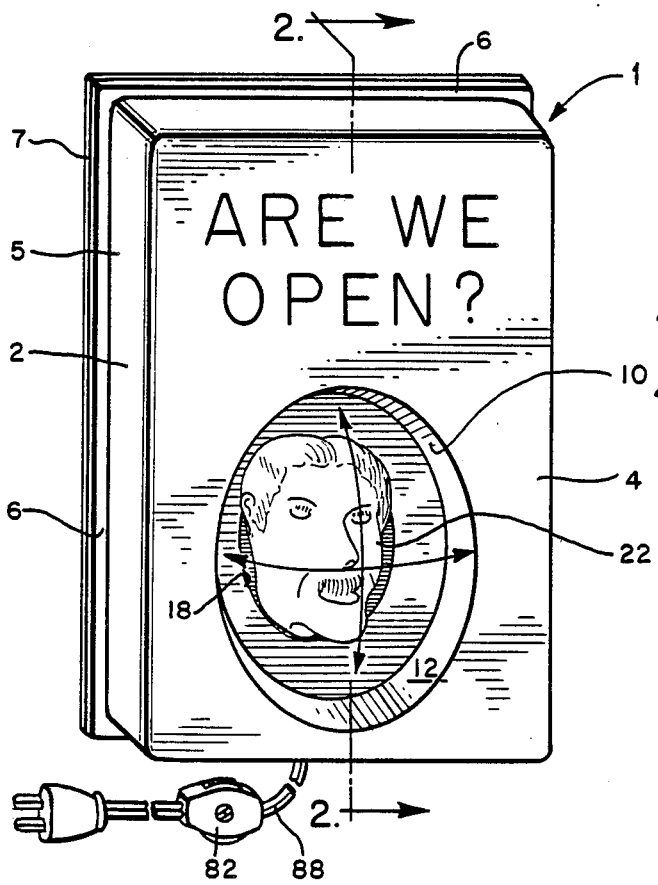
FIG. 2
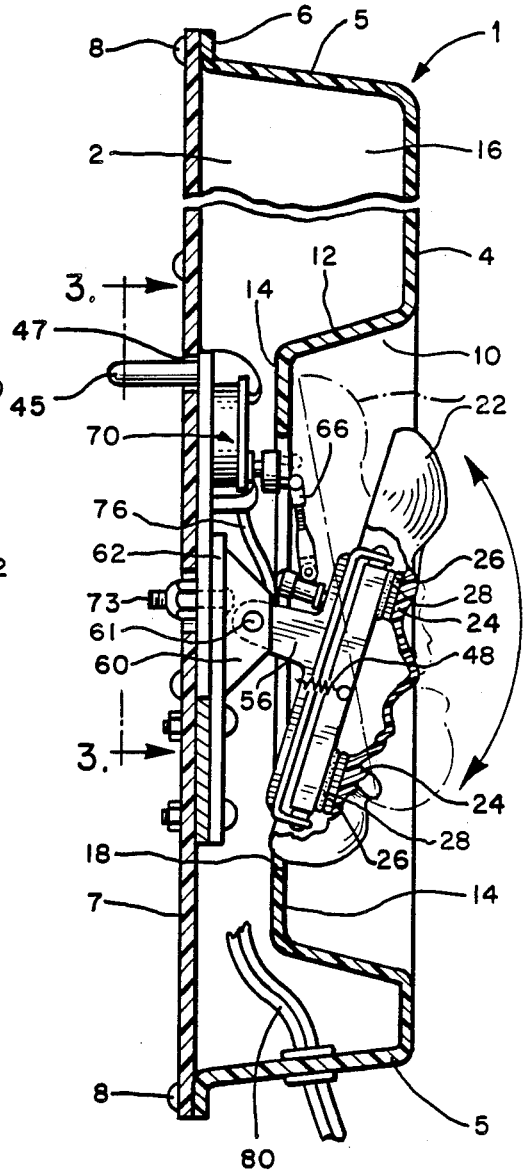
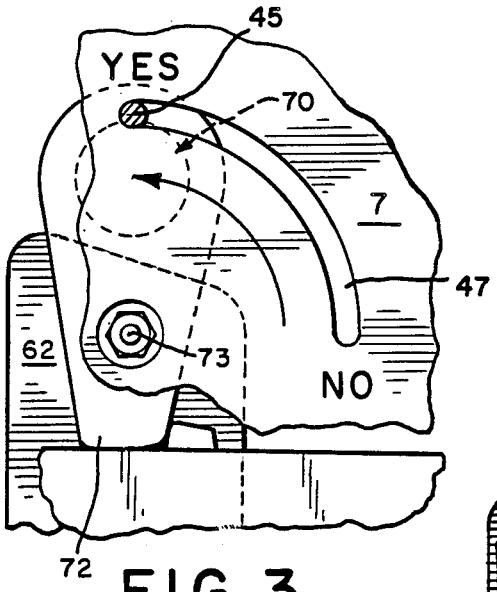
FIG. 3
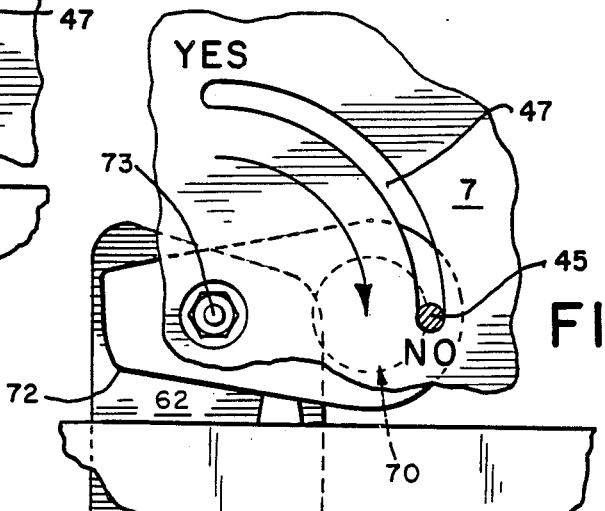
FIG. 3a

FIG. 4
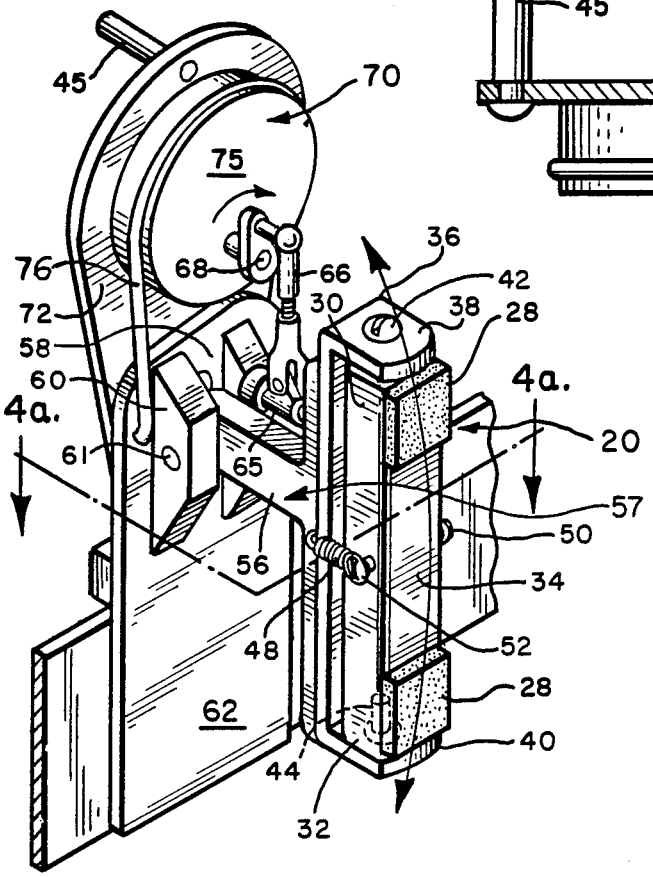
FIG. 5a
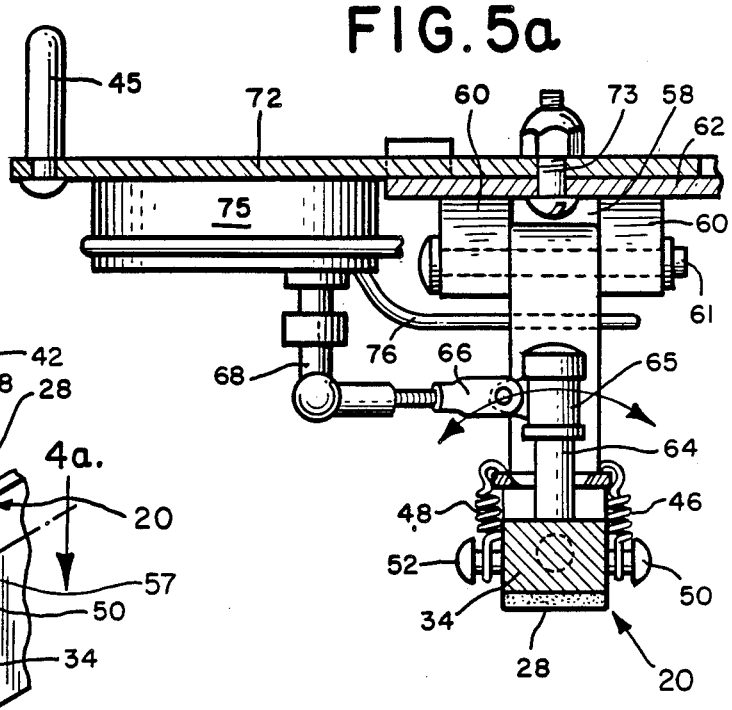
FIG. 4a
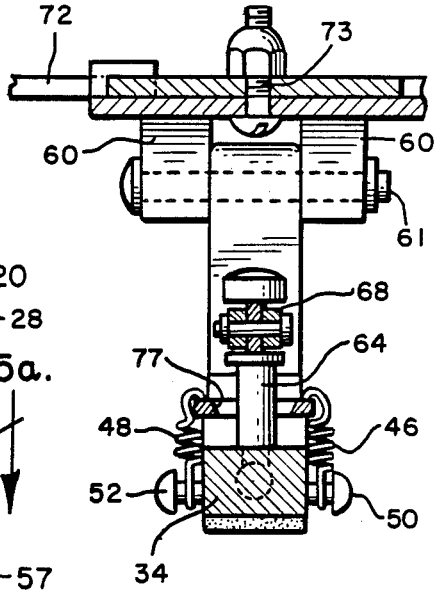
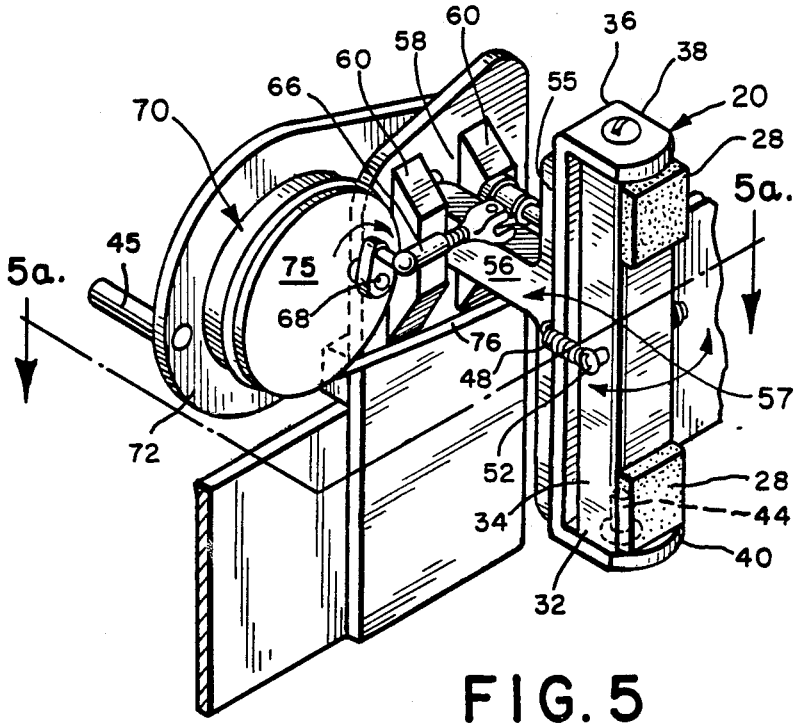
FIG. 5

ANIMATED SIGN

BACKGROUND OF THE INVENTION

This invention relates to animated signs and more specifically to signs which are designed to attract a passerby by and deliver a message in pantomime.

Common signs are static in that they consist of a plain paperboard or plastic sheet with a legend thereon on one side that states a message on one side, for example, that the premises are open and on the opposite side that the premises are "not open" or "closed".

Such signs if positioned in a cluttered window are easily lost to the eye, i.e. comouflaged, and cause a prospective customer to be frustrated, especially if he had to leave his car to read the message.

Admittedly various action signs have heretofore been provided with movable parts to stress a message, but these have been costly and not adaptable to window use and which are easily adjusted to impart different messages.

SUMMARY OF THE INVENTION

This invention pertains to action signs which are simple to manufacture and are relatively inexpensive.

A general object of the invention is to provide a sign mechanism in which the parts cooperate to functionally maintain themfrom premature wear and tear.

More specifically one object is to provide a sign in which the mechanism is driven by an inexpensive electrical motor and in which the driven part serves as a cooling medium for the motor to obtain extended life.

The invention comprehends a simple mechenical drive for a sign indicia which is movable in one direction indicating that the premises are open and in which the mechanism by simply shifting its position operates the sign indicia to indicate that the premises are not open.

The invention also provides a novel arrangement of components in which the movable indicia member serves to fan the motor drive.

It is a further object of the invention to provide a novel drive and mounting for the indicia member to accommodate pivoting of the member on one axis when the drive linkage is disposed in one position and to cause the indicia member to pivot on another axis when the drive linkage is disposed in a second position.

These and other objects and advantages inherent in the invention will become more apparent from the specification and the drawings, wherein:

FIG. 1 is a front perspective view of the novel sign;

FIG. 2 is an enlarged cross-section taken essentially on line 2—2 of FIG. 1;

FIG. 3 is a fragmentary back view of the sign showing the shifting pattern taken substantially on line 3—3 of FIG. 2 showing the mechanism in the "yes" position;

FIG. 3*a* is a view similar to FIG. 3 showing the drive shifted to the "no" position;

FIG. 4 is a perspective view of the drive mechanism showing the drive in the "yes" position;

FIG. 4*a* is a cross-section taken substantially on line 4*a*—4*a* of FIG. 4;

FIG. 5 is a perspective view showing the parts in the "no" position, and

FIG. 5*a* is a cross-section taken substantially on line 5*a*—5*a* of FIG. 5.

DESCRIPTION OF THE INVENTION

The invention is disclosed in the associated drawings which illustrate a motile sign generally designated 1 having a body or frame 2 of rectangular box-like construction comprising a front wall or panel 4 integrally united with four perimetrical walls 5,5 which at their inner edges are formed with outturned flanges 6 seated against a vertical mounting panel 7 and connected thereto as by screws 8 or otherwise.

The front panel is recessed to provide a cavity 10 defined by a peripheral cowling wall 12 which is integrated at its inner edge with a vertical web or flange 14 disposed intermediate the front and rear panels 4 and 7 in the space 16 within the housing. The flange 14 defines about its margin an aperture 18 therein through which protrudes a drive assembly 20 for moving an indicator element 22.

The indicator element 22 is shown herein as a hollow face mask having on its back side centrally thereof attachment areas 24 to which are adhered quick connectors 26,26, herein shown as Velcro pads which mate and interlock releasably with similar pads 28,28 mounted on the upper and lower ends 30,32 of a pivot block or output element 34 of the drive linkage or mechanism generally designated 20.

The distal output or end member or block 34 is fitted within a jaw 36 which has upper and lower jaw mwmbers 38,40 receiving the block 34 therein. The block is pivoted on a vertical axis by means of vertically aligned screws 42,44 extending through apertures in the jaws and threaded into respective ends of the block.

The block is held in a centered neutral position by a pair of yieldable return biasing means in the form of tension springs 46,68 which are connected at one of their ends to the opposite sides of the block by screws 50,52 threaded into the respective sides of the block. The rear ends of the springs are hooked to respective opposite edges of a vertical spanner portion 55 connecting the jaw portions 38,40. The spanner is spaced rearwardly from the block and returns the block to centered position.

The spanner is connected between its top and bottom ends to a reawardly extending yoke reach 56 of a yoke 57, which at its rear end extends into a vertical slot 58 defined between a pair of horizontally spaced brackets or lugs 60,60, which are secured at their rear ends in any conventional manner as by adhesives, screws etc. to a mounting board 62 secured to the rear wall 7. The yoke 57 is pivoted on a horizontal axis by a pin 61 extending through its rear end and through the lugs 60,60.

The output member or block 34 has a rearwardly projecting stub shaft 64 which is connected by means of a bearing and swivel assembly 65 to one end of a pitman 66 which at its other end has a ball-joint connection to a crank arm 68 eccentrically mounted on a drive wheel of an electric motor generally designated 70.

The motor is mounted on a shift arm 72, which at its other or lower end is pivotally supported from one of the frame members 62 on a generally horizontal axis by pivot bolt 73, the axis of the bolt intersecting the vertical pivot axis of the block 34 defined by the screws 42,44, which are coaxially positioned.

In the position of the drive parts shown in FIGS. 4 and 4*a*, which is the "yes" mode of operation of the sign, the support arm 72, operated by a handle 45 extending through arcuate slot 47 in rear wall 7, is disposed vertically as best seen in FIG. 3 during which the pitman 66 extends substantially vertically from the crank to the output stub shaft 64 and virtually supports the yoke 57 and the block 34 as well as the mask 22. As the crank is rotated the yoke 57 and the block 34 pivot about the shaft 61 and thus the mask swings up and down in a "yes" motion or mode. At the same time the mask in the confinement withing the cavity or cowling in the front wall swishes air into the chamber 16 and wafts or fans the air into and over the housing confining the electric motor keeping it relatively cool for long life.

The motor and crank assembly are movable to a horizontal position as shown in FIGS. 5, 5*a* whereat the pitman extends horizontally and drives the output shaft and mask back and forth horizontally in a reciprocal motion indicating a "no" mode.

In order to insure that in the "no" mode the pendular member 57 does not droop, the motor housing 75 is provided with a support arm 76 which moves under the yoke 57 as best seen in FIG. 5*a* and holds it in a substantially horizontal position whilst the block 34 oscillates about the vertical axis as defined by the screws 42,44. The springs at opposite sides of the block expand and contract and assist to bring the block to its centered position.

The stub shaft moves laterally within the horizontally elongated slot 77 in the spanner in the "no" mode.

In operation the user hangs the sign in a window and connects the line 80 with a wall socket and actuates the switch 82 to start and stop the motor. The operator then sets the mechanism to the desired mode "yes" as seen in FIG. 3 or "no" as seen in FIG. 3*a* and locks it in place.

It will be understood that any question may be posed such as "Are the Bears winning?" etc. Suitable replaceable letters, such as magnetic blocks may be used to compose the question.

Various embodiments will now become apparents which are intended to be covered by the appended claims.

We claim:

1. A motile sign comprising:

a support structure, a movable message indicator operable in two modes for transmitting different messages, manually shiftable drive means for the indicator, said drive means mounting said indicator, said drive means comprising a crank-driven pitman positionable in a first position for oscillating said indicator in a first direction to operate in a first mode, and said drive means positionable in a second position for operating said indicator in another direction in a second mode.

2. A motile sign comprising:

a support structure, a movable message indicator, drive means for said indicator mounted on said structure, said drive means mounting said indicator, said drive means comprising a crank-driven pitman positionable in a first position for oscillating said indicator in a first direction to operate in a first mode, and said drive means positionable in a second position for operating said indicator in another direction in a second mode, and said drive means comprising a pendulous carrier oscillatable about a horizontal axis in said first mode, and means mounted to move conjuctively with said drive means from the first mode to the second mode adapted to extend under said carrier to support the same attendant to said drive means being disposed in said second mode.

3. The invention according to claim 1 and said drive means comprising an electrical motor, and said support structure comprising a cavity and said indicator being positioned in said cavity and said structure defining a chamber enclosing said motor, said cavity having a passage communicating with said chamber, and said indicator being operative during movement thereof to fan air into said chamber for cooling said motor.

4. The invention according to claim 1 and said drive means comprising an output member connected to said indicator and oscillatable about a vertical axis attendant to the drive being displaced into said second mode.

5. The invention according to claim 4 and means for biasing said output member to a neutral position.

6. A sign having a movable message telegraphing element oscillatable selectively horizontally and vertically, a yoke assembly mounted for vertical pendular movement and having a distal portion oscillatable about a vertical axis, means connecting said element to said distal portion, and drive means for alternately selectively driving said yoke assembly to pendulate vertically or to oscillate said distal portion horizontally for concurrently likewise moving said element.

7. The invention according to claim 6 and said drive means comprising a crank-driven pitman operatively connected to said yoke assembly through said distal portion and alternatively positionable vertically or horizontally for similarly moving said element through said yoke assembly.

8. The invention according to claim 6 and said means for securing said distal portion to said element comprising quick-attach means.

9. The invention according to claim 6 and said yoke assembly comprising a horizontal slot therein and a drive component of said drive means extending from said distal portion through said slot and, said drive means oscillating said drive component within said slot during horizontal oscillation of said element.

10. The invention according to claim 9 and means reactive between said yoke assembly and said distal portion yieldably biasing said distal portion to a centered position.

11. The invention according to claim 6 and means operatively responsive to conditioning of said drive means to oscillate said portion horizontally to a position supporting said yoke assembly against pendular vertical movement.

12. The invention according to claim 6 and an electric motor drive for said drive means, and cowling means enclosing and cooperable with said element for ducting cooling air onto said motor.

13. The invention according to claim 6 and said element being in the form of a face mask and in pendulating vertically indicating "yes" and in oscillating horizontally indicating "no".

14. The invention according to claim 6 and a housing comprising front and rear panels and peripheral walls interconnecting said panels and forming a chamber therewith, and said front panel having a depression enclosing said element and having an opening communicating with said chamber, said element being operative to pump air through said opening into said chamber, and said drive means having a heat susceptible component disposed within said chamber for cooling by air being delivered into said chamber.

15. A motile sign comprising a housing having a front portion and an internal chamber, a message transmitting movable element recessed within said front portion comprising a face mask, and a resetable drive mechanism within said chamber connected to said element and having common linkage for selectively oscillating the same either vertically or horizontally in the fashion of a person indicating "yes" and "no", respectively.

16. The invention according to claim 15 and said element being operative to scoop air from outside said housing and pump it into the chamber for cooling components of said drive mechanism.

17. The invention according to claim 15 and said drive mechanism comprising a pitman drive and members movable thereby vertically and horizontally, and means for shifting said drive to oscillate said members vertically and horizontally and thus correspondingly moving said element.

18. The invention according to claim 17 and means pivotally mounting certain of said members on horizontal and vertical pivot axes, respectively.

19. The invention according to claim 18 and means for biasing one of the members pivotally on said horizontal axis to a position intermediate the extremes of oscillatory displacement thereof about said vertical axis.

* * * * *